US005418210A

United States Patent [19]

Egashira et al.

[11] Patent Number: 5,418,210

[45] Date of Patent: * May 23, 1995

[54] HEAT TRANSFER SHEET

[75] Inventors: Noritaka Egashira; Masashi Narita; Hideo Fujimura; Yoshinori Nakamura, all of Tokyo, Japan

[73] Assignee: Dai Nippon Insatsu Kabushiki Kaisha, Japan

[ * ] Notice: The portion of the term of this patent subsequent to Jun. 2, 2009 has been disclaimed.

[21] Appl. No.: 85,915

[22] Filed: Jul. 6, 1993

Related U.S. Application Data

[62] Division of Ser. No. 667,315, Mar. 12, 1991, Pat. No. 5,252,532.

[30] Foreign Application Priority Data

Mar. 15, 1990 [JP] Japan ..... 2-62721
Jan. 18, 1991 [JP] Japan ..... 3-16862

[51] Int. Cl.[6] ..... B41M 5/035; B41M 5/38

[52] U.S. Cl. ..... 503/227; 428/195; 428/423.1; 428/522; 428/913; 428/914

[58] Field of Search ..... 8/471; 428/195, 423.1, 428/913, 914, 522; 503/227

[56] References Cited

U.S. PATENT DOCUMENTS 4,700,207 10/1987 Vanier et al. ..... 503/227
4,876,236 10/1989 Vanier et al. ..... 503/227
5,063,198 11/1991 Imai et al. ..... 503/227
5,118,658 1/1992 Egashira et al. ..... 503/227

FOREIGN PATENT DOCUMENTS 59-169894 9/1984 Japan ..... 503/227

*Primary Examiner*—B. Hamilton Hess
*Attorney, Agent, or Firm*—Parkhurst, Wendel & Rossi

[57] ABSTRACT

A heat transfer sheet including a substrate film and a dye layer including a dye and a binder formed thereon, wherein the binder includes organic-solvent-soluble polymers having ester moieties and/or urethane moieties, prepared by modifying water-soluble natural and/or semisynthetic polymers by esterifying and/or urethanating an inner hydroxyl group thereof, and the dye includes a sublimable dye homogeneously dissolved in the binder. A heat transfer sheet is also disclosed which includes a substrate film, and a dye layer formed thereon, wherein the dye layer includes (i) a binder which is cellulose acetate having an acetylation rate of 2.4 or more and a total substitution rate of 2.7 or more, and (ii) a sublimable dye dissolved in the binder. The sublimable dye contained in the dye layer is not separated from the binder even when the heat transfer sheet is preserved for a long period of time. Furthermore, the heat transfer sheet can produce a high-density image even when only a small amount of thermal energy is applied thereto.

2 Claims, No Drawings

HEAT TRANSFER SHEET

This application is a Rule 60 Divisional application of U.S. Ser. No. 07/667,315 filed Mar. 12, 1991, now U.S. Pat. No. 5,252,532.

BACKGROUND OF THE INVENTION

This invention relates to a heat transfer sheet having high preservability and high thermal sensitivity.

An ink jet method and a heat transfer printing method are now rapidly replacing conventional recording and printing methods. This is because a monochromic or full-colored image having high quality can be simply and promptly produced by these methods. Of these methods, a sublimation-type heat transfer printing method utilizing a sublimable dye is far superior to the other methods because a full-colored image with an excellent continuous gradation, comparable to a photographically obtainable image, can be obtained by this method.

A heat transfer sheet prepared by providing a dye layer (heat transfer layer) containing a sublimable dye and a binder on one surface of a substrate film such as a polyester film, and a heat resistive layer on the other surface of the substrate film, which prevents the heat transfer sheet from adhering to a thermal head upon heat transfer printing, is generally used with the sublimation-type heat transfer printing method. Together with the heat transfer sheet is used a heat transfer image-receiving sheet which has a dye-receiving layer comprising a polyester resin. To conduct heat transfer printing, the heat transfer sheet is superposed on the heat transfer image-receiving sheet so that the dye layer faces the dye-receiving layer, and thermal energy is then applied by a thermal head to the back surface of the substrate film of the heat transfer sheet. The sublimable dye contained in the dye layer of the heat transfer sheet thus transfers imagewise to the dye-receiving layer of the heat transfer image-receiving sheet to produce therein a desired image.

When the sublimation-type heat transfer printing method is carried out, only the sublimable dye contained in the dye layer of the heat transfer sheet transfers to the heat transfer image-receiving sheet, and the binder in the dye layer remains on the substrate film. A sharp image with high density can be obtained when the dye has high transferability.

A conventional heat transfer sheet exhibits high transferability of dye right after the production thereof. The transferability of dye, however, gradually deteriorates as time goes by. As a result, the heat transfer sheet which has been preserved for a long period of time produces an unfavorable image with low density. A conceivable reason for the above is that the dye, which exists in the binder in a homogeneously dissolved or finely dispersed state when the heat transfer sheet is prepared, is gradually separated from the binder and crystallizes with the passage of time.

A binder which can readily dissolve therein a sublimable dye and has high hydrophobicity can eliminate the above shortcoming. Namely, when such a binder is employed, the dye will not be easily separated from the binder. In this case, however, high transferability of dye cannot be expected because the binder has an excessively high affinity for the dye.

On the other hand, when a binder having high water solubility is used, the dye, which is generally insoluble in water, cannot be dissolved but is only dispersed in the binder. As a result, the dye cannot easily transfer to a heat transfer image-receiving sheet even when heat transfer printing is carried out by using a fresh heat transfer sheet. In addition, the heat transfer sheet comprising such a binder in its dye layer cannot endure long-term preservation.

SUMMARY OF THE INVENTION

Accordingly, an object of the present invention is to provide a heat-transfer sheet which can overcome the aforementioned drawbacks resided in the prior art, and can produce a high-density image even after long-term preservation thereof and even with application of a small amount of thermal energy.

The foregoing object of the present invention can be accomplished by a heat transfer sheet comprising a substrate film, and a dye layer formed thereon, comprising (i) a binder which comprises organic-solvent-soluble polymers having ester moieties and/or urethane moieties, prepared by modifying water-soluble natural and/or semisynthetic polymers by esterifying inner hydroxyl groups thereof, and (ii) a sublimable dye homogeneously dissolved in the binder.

Since organic-solvent-soluble polymers having ester moieties and/or urethane moieties, prepared by modifying water-soluble natural and/or semisynthetic polymers by esterifying and/or urethanating inner hydroxyl groups thereof are used as the binder in the dye layer, the sublimable dye can be homogeneously dissolved in the binder, and is not separated from the binder even when the heat transfer sheet is preserved for a long period of time. Further, the binder for use in the present invention also contains water-soluble segments in its molecules, so that it has a moderate affinity for the dye. For this reason, the heat transfer sheet according to the present invention can produce a high-density image even after long-term preservation thereof, and even with application of a small amount of thermal energy.

The object of the present invention can also be accomplished by a heat transfer sheet comprising a substrate film, and a dye layer formed thereon, comprising (i) a binder which is cellulose acetate having an acetylation rate of 2.4 or more, and a total substitution rate of 2.7 or more, and (ii) a sublimable dye dissolved in the binder.

Since cellulose acetate having an acetylation rate of 2.4 or more and-a total substitution rate of 2.7 or more is used as the binder in the dye layer, the dye is not separated from the binder even when the heat transfer sheet is preserved for a long period of time. Moreover, the heat transfer sheet of the present invention can produce an image with high density even when a small amount of thermal energy is applied thereto.

DETAILED DESCRIPTION OF THE INVENTION

The present invention will now be explained with reference to preferred embodiments.

The heat transfer sheet of the present invention comprises a substrate film and a dye layer formed thereon, and such a constitution of the invention is the same as that of conventional heat transfer sheets. The heat transfer sheet according to the first embodiment of the present invention is however distinguishable over conventional ones in that the binder contained in the dye layer comprises organic-solvent-soluble polymers having ester moieties and/or urethane moieties, prepared by modifying water-soluble natural and/or semisynthetic polymers by esterifying and/or urethanating inner hydroxyl groups thereof.

Any conventionally known film having proper heat resistance and mechanical strength can be employed as the substrate film of the heat transfer sheet of the present invention. For instance, ordinary paper, various types of processed paper, a polyester film, a polystyrene film, a polypropylene film, a polysulfone film, an aramide film, a polycarbonate film, a polyvinyl alcohol film, and a cellophane film are usable. Of these, a polyester film is preferred. The above-enumerated substrate films can be used either as a continuous film or as a non-continuous film. The thickness of the substrate film is from 0.5 to 50 μm, preferably from 3 to 10 μm.

Any sublimable dye which has been used in conventional heat transfer sheets is employable in the present invention. For instance, the following dyes are preferably used in the present invention: MS Red G, Macrolex Red Violet R, Ceres Red 7B, Samaron Red HBSL, and Resolin Red F3BS as red dyes; Phorone Brilliant Yellow 6GL, PTY-52, and Macrolex Yellow 6G as yellow dyes; and Kayaset Blue 714, Waxoline Blue AP-FW, Phorone Brilliant Blue S-R, and MS Blue 100 as blue dyes.

To provide a dye layer on the substrate film, the above dye is used along with a binder comprising organic-solvent solvent-soluble polymers having ester moieties and/or urethane moieties, prepared by modifying water-soluble natural and/or semisynthetic polymers by esterifying inner hydroxyl groups thereof.

Examples of the water-soluble natural and/or semisynthetic polymer for use in the present invention include starches prepared by polymerizing α-glucose by an α-1,4-glucosidic linkage, water-soluble derivatives of cellulose prepared by polymerizing β-glucose by a β-1,4-glucosidic linkage, alginic acids prepared by polymerizing pyranose by a β-1,4-glucosidic linkage, maltotrioses which are trimers of D-glucose, prulans which are water-soluble polysaccharides prepared by repeatedly bonding α-D-1,6-glucose at its 1 and 6 positions, dextrans which are polymers containing D-glucopyranose obtainable from saccharose as a repeating unit, and cardrans which are linear β-1,3-glucans prepared by polymerizing D-glucose by a β-1,3-glucosidic linkage. These water-soluble polymers can be used either singly or in combination.

According to the first embodiment of the present invention, the water-soluble natural and/or semisynthetic polymers are modified by esterifying inner hydroxyl groups thereof to give polymers having ester moieties and/or urethane moieties. The modified polymers thus obtained are soluble in an organic solvent, in which the sublimable dye can also be dissolved.

The esterification rate of the inner hydroxyl groups varies depending on the water-soluble polymers. Some water-soluble polymers are required that all their inner hydroxyl groups are esterified so as to impart proper organic-solvent solubility to the resulting modified polymers, and some are not. Thus, the esterification rate cannot be specified.

However, when organic-solvent-soluble polymers prepared by modifying the water-soluble polymers have an insufficient amount of ester moiety and/or urethane moiety, they have low solubility in an organic solvent. As a result, the modified polymers cannot have a high affinity for the sublimable dye, and the dye tends to be separated from the binder during long-term preservation of the heat transfer sheet. Also, the dye separated and deposited on the surface of the dye layer stains the background of a heat transfer image-receiving sheet when heat transfer printing is conducted.

The above-described esterification of inner hydroxyl groups of the water-soluble natural and/or semisynthetic polymers can be carried out by using any one of known aliphatic or aromatic acids or derivatives thereof, and isocyanate compounds. In addition to these compounds, those compounds containing siloxane segments or long-chained alkyl groups can also be used. When such a compound is used for the modification of the water-soluble polymers, releasing ability can be imparted to the resulting modified polymers. Therefore, the heat transfer sheet comprising the polymers thus obtained as the binder in its dye layer is prevented from sticking to a heat transfer image-receiving sheet when heat transfer printing is carried out.

According to the second embodiment of the present invention, cellulose acetate is used as a binder in the dye layer. Cellulose acetate is a compound prepared by substituting, by an acetic acid group, at least one of three hydroxyl groups contained in a glucose anhydride unit of cellulose. In the present invention, cellulose acetate having an acetylation rate of 2.4 or more, and a total substitution rate of 2.7 or more is preferably employed.

When the acetylation rate of cellulose acetate is less than 2.4, the affinity between the binder and the dye is not sufficiently high. As a result, the dye gradually crystallizes, resulting in deterioration of transferability of the dye. In addition, even if the dye exists in the binder in a homogeneously dissolved state right after the preparation of the heat transfer sheet, it will be separated from the binder as times goes by, causing deterioration of transferability of the dye. Also, the dye separated and deposited on the surface of the dye layer stains the background of a heat transfer image-receiving sheet when heat transfer printing is carried out. Furthermore, when the total substitution rate of cellulose acetate is less than 2.7, the same problems occur.

It is desirable to further substitute unsubstituted hydroxyl groups in the cellulose acetate so as to give urethane moieties thereto. For instance, it is preferable to substitute such hydroxyl groups by treating the cellulose acetate with an aromatic or aliphatic monoisocyanate.

The heat transfer sheet of the present invention can be prepared in accordance with the following method:

The above-described binder and sublimable dye, and other additives such as a releasing agent are thoroughly dissolved in a proper organic solvent, or finely dispersed in an organic solvent or water. The solution or dispersion thus obtained is applied onto at least one surface of a substrate film by means of gravure printing, screen printing, or reverse roll coating using a gravure, and then dried to form a dye layer.

The thickness of the dye layer is from 0.2 to 5.0 μm, preferably 0.4 to 2.0 μm. The amount of the sublimable dye contained in the dye layer is 5 to 90 wt. %, preferably 10 to 70 wt. %, of the total weight of the dye layer.

In order to obtain a monochromic image, the dye layer is formed by using one of the previously-mentioned dyes. For the purpose of obtaining a full-colored image, the dye layer is prepared by using dyes of cyan, magenta, yellow, and if necessary black colors accordingly.

Any heat transfer image-receiving sheet which is receptive to the sublimable dye contained in the dye layer of the heat transfer sheet can be used together with the heat transfer sheet of the present invention. Even those materials which are not receptive to the dye, such as paper, metals, glass and synthetic resins can be used as heat transfer image-receiving sheets if they are provided with a dye-receiving layer on at least one surface of sheets or films of the above materials.

To conduct heat transfer printing by using the heat transfer sheet of the present invention and the above-described heat transfer image-receiving sheet in combination, any conventional means for applying thermal energy is employable. For instance, recording apparatus such as a thermal printer, Trademark "Video Printer VY-100" manufactured by Hitachi Co., Ltd., are usable for the purpose. A desired image can be obtained by applying thermal energy in an amount of 5 to 100 $mJ/mm^2$, which is changeable by controlling the printing time, by the thermal printer to the heat transfer sheet.

The first embodiment of this invention will now be explained more specifically with reference to the following examples, which are given for illustrating of this invention and are not intended to be limiting thereof. Throughout these examples, quantities expressed in "percent (%)" and "parts" are "percent by weight" and "parts by weight", respectively.

Synthesis Example 1

Preparation of Modified Polymer P-1

Twenty parts of pluran, Trademark "PF-20" manufactured by Hayashibara K.K., Japan, 60 parts of pyridine, and 220 parts of acetone were placed in a flask equipped with a thermometer, a stirrer and a dropping funnel, and were thoroughly mixed at an elevated temperature of 40° C. to obtain a dispersion of pluran. A mixture of 60 parts of acetyl chloride and 140 parts of acetone was added dropwise from the dropping funnel into the dispersion of pluran over approximately 30 minutes while keeping the temperature of the reaction system to 50° C. or less. A milky white hydrochloride precipitated when the mixture of acetyl chloride and acetone was dropped to the dispersion of pluran. After the dropping was completed, the reaction mixture was stirred at 40° C. for two hours to complete the reaction. The reaction mixture was then allowed to stand still to separate the hydrochloride. After removing the precipitated hydrochloride, the supernatant liquid was poured into water, thereby precipitating a modified polymer.

The above-obtained polymer was repeatedly subjected to reprecipitation using a mixed solvent of acetone and water until offensive odors of pyridine and acetic acid were completely removed from the polymer. The polymer thus purified was then dried under a reduced pressure to obtain a modified polymer, P-1, for use in the present invention.

The modification rate of this polymer, that is, the esterification rate of inner hydroxyl groups, which is shown in Table 1, was determined by measurement using Nuclear Magnetic Resonance (NMR) and calculation.

Synthesis Example 2

Preparation of Modified Polymer P-2

Twenty parts of pluran, Trademark "PF-20" manufactured by Hayashibara K.K., 230 parts of benzene, and 0.1 parts of tin dibutyl dilaurate were placed in a flask equipped with a thermometer, a stirrer and a dropping funnel, and were thoroughly mixed at an elevated temperature of 50° C. to obtain a dispersion of pluran. A mixture of 30 parts of phenyl isocyanate and 140 parts of benzene was added dropwise into the dispersion of pluran from the dropping funnel over approximately 30 minutes while keeping the temperature of the reaction system to 50° C. or less. After the dropping was completed, the reaction mixture was stirred at 60° C. for two hours to complete the reaction. The reaction mixture was cooled, and then poured into cooled methanol, thereby precipitating a modified polymer.

The above-obtained polymer was purified by reprecipitation using a mixed solvent of benzene and methanol, followed by drying under a reduced pressure to obtain a modified polymer, P-2, for use in the present invention.

The modification rate of this polymer, which is shown in Table 1, was determined by measurement using NMR and calculation.

Synthesis Examples 3 to 13

Preparation of Modified Polymers P-3 to P-13

In accordance with the procedure described in Synthesis Example 2, the water-soluble natural and semi-synthetic polymers shown in Table 1 were respectively modified to obtain modified polymers, P-3 to P-13, for use in the present invention.

The modification was carried out by respectively reacting the water-soluble polymers with proper compounds as shown in Table 1.

The modification rates of the modified polymers thus obtained were respectively determined by measurement using NMR and calculation. The results are shown in Table 1.

TABLE 1

| Polymer No. | Water-Soluble Polymer | Type of Reaction | Reacting Compound | A (%) | B |
|---|---|---|---|---|---|
| P-1 | Pluran | E | Acetyl chloride | 93.6 | |
| P-2 | Pluran | U | Phenyl isocyanate | 89.8 | |
| P-3 | Pluran | E | Acetyl chloride | 82.7 | |
| P-4 | Pluran | E | Stearyl chloride | 94.5 | ∘ |
| P-5 | Pluran | E | Modified silicone* | 85.1 | ∘ |
| P-6 | Starch | E | Acetyl chloride | 95.0 | |
| P-7 | Hydroxy ethyl cellulose | E | Stearyl chloride | 91.3 | ∘ |
| P-8 | Hydroxy ethyl cellulose | U | n-Octadecyl isocyanate | 90.7 | ∘ |
| P-9 | Alginic acid | E | Acetyl chloride | 94.2 | |
| P-10 | Dextran | E | Acetyl chloride | 91.8 | |
| P-11 | Dextran isocyanate | U | n-Propyl | 88.4 | |
| P-12 | Cardran | E | Acetyl chloride | 92.1 | |
| P-13 | Cardran | U | Phenyl isocyanate | 90.9 | |

[NOTE]
In Table 1,
"A": modification rate determined by measurement using NMR and calculation;
"B": releasing ability;
"∘": good releasing ability was exhibited;
"E": modified polymer had ester moieties;
"U": modified polymer had urethane moieties; and
"Modified silicone*": modified silicone oil having the following formula (molecular weight = 1,000).

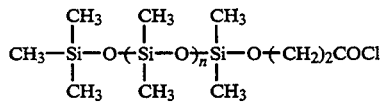

EXAMPLES A1 to A13

By using modified polymers P-1 to P-13 prepared in Synthesis Examples 1 to 13 as binders, ink compositions for forming dye layers having the following formulation were respectively prepared. The ink compositions were respectively applied by means of gravure printing onto a surface of a substrate film, a polyethyleneterephthalate film having a thickness of 6 μm, backed with a heat resistive smoothing layer, in an amount of 1.0 g/m$^2$ on dry basis, and then dried. Heat transfer printing sheets according to the present invention were thus obtained in a state of continuous film.

| <Formulation of Ink Composition> | |
|---|---|
| Dye No. 1 having the following formula: | 5.5 parts |

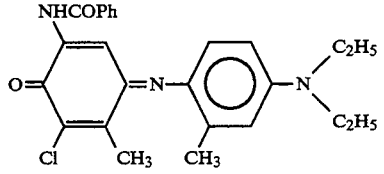

| | |
|---|---|
| Modified polymer (binder) | 3.0 parts |
| Methylene chloride | 81.5 parts |
| Ethanol | 10.0 parts |

Comparative Examples A1 to A6

By using polymers P-14 to P-19 shown in Table 2 as binders, ink compositions for forming dye layers having the following formulation were respectively prepared. The procedure in Examples A1 to A13 was repeated except that the ink compositions used in Examples A1 to A13 were replaced by the above-prepared ink compositions, thereby obtaining comparative heat transfer printing sheets.

| *Formulation of Ink Composition: | |
|---|---|
| Dye No. 1 | 5.5 parts |
| Polymer (binder, see Table 2) | 3.0 parts |
| Solvent which can dissolve the above polymer, selected from water, acetone, a mixed solvent of acetone and water, and alcohol | 91.5 parts |

TABLE 2

| No. | Polymer |
|---|---|
| P-14 | Cellulose acetate, Trademark "LL-10" manufactured by Daicel Chemical Industries, Ltd. |
| P-15 | Starch, reagent of special grade |
| P-16 | Pluran, Trademark "PF-20" manufactured by Hayashibara K.K. |
| P-17 | Alginic acid, reagent of special grade |
| P-18 | Dextran, reagent of special grade |
| P-19 | Cardran, manufactured by Takeda Chemical Industries, Ltd. |

Evaluation A

1. Preparation of Heat Transfer Image-Receiving Sheet

A coating liquid for forming an image-receiving layer, having the following formulation was applied onto a surface of a substrate film, a sheet of synthetic paper, Trademark "Yupo FPG 150" manufactured by Oji-Yuka Synthetic Paper Co., Ltd., in an amount of 6.0 g/m$^2$ on dry basis, and then dried at 80° C. for 10 minutes, thereby obtaining a heat transfer image-receiving sheet

| Formulation of Coating Liquid for Forming Image-Receiving Layer | |
|---|---|
| Polyester resin (Trademark "Vylon 600", manufactured by Toyobo Co., Ltd.) | 4.0 parts |
| Vinyl chloride - vinyl acetate copolymer (Trademark "Denka Vinyl #1000A" manufactured by Denki Kagaku Kogyo K.K.) | 6.0 parts |
| Amino-modified silicone oil (Trademark "X-22-3050C" manufactured by Shin-Etsu Chemical Co., Ltd.) | 0.2 parts |
| Epoxy-modified silicone oil (Trademark "X-22-3000E" manufactured by Shin-Etsu Chemical Co., Ltd.) | 0.2 parts |
| Methyl ethyl ketone | 44.8 parts |
| Toluene | 44.8 parts |

2. Relative Sensitivity

The relative sensitivities of the heat transfer printing sheets according to the present invention prepared in Examples A1 to A13, and those of the comparative heat transfer sheets prepared in Comparative Examples A1 to A6 were determined after the preparation thereof, by subjecting them to heat transfer printing in accordance with the following manner.

Namely, each heat transfer sheet was superposed on the above-obtained heat transfer image-receiving sheet so that the dye layer faced the dye-receiving layer. Thermal energy was then applied to the back surface of the heat transfer sheet by a thermal head (KMT-85-6, MPD 2) to produce an image in the heat transfer image-receiving sheet. The printing conditions were as follows:

Electric voltage applied to thermal head: 12.0 V

Pulse width: applied step pattern method, 16.0 msec/-line at outset, reduced stepwise every 1 msec Dot density in sub-scanning direction: 6 dots/mm (=33.3 msec/line)

The optical density of each image thus obtained was measured. The optical density of the image obtained by using the heat transfer sheet prepared in Comparative Example A1 was indicated by 1.0, and those of images obtained by using the other sheets were indicated by relative values thereto.

The heat transfer sheets according to the present invention and the comparative ones were then preserved at 60° C. for 30 days. Thereafter, the same procedure as the above was repeated, and the relative sensitivities were determined.

The results are shown in Table 3.

3. Change in Dye Layer after Preservation

The surfaces of the dye layers of the heat transfer sheets according to the present invention and those of the comparative ones were visually observed right after the preparation thereof, and also after the preservation at 60° C. for 30 days.

The results are shown in Table 3.

TABLE 3

| | Binder in dye layer | Relative Sensitivity A | Relative Sensitivity B | Change in dye layer after preservation |
|---|---|---|---|---|
| Example A1 | P-1 | 1.8 | 1.8 | unchanged |
| Example A2 | P-2 | 1.6 | 1.6 | unchanged |
| Example A3 | P-3 | 1.7 | 1.7 | unchanged |

TABLE 3-continued

| | Binder in dye layer | Relative Sensitivity A | Relative Sensitivity B | Change in dye layer after preservation |
|---|---|---|---|---|
| Example A4 | P-4 | 1.6 | 1.6 | unchanged |
| Example A5 | P-5 | 1.5 | 1.5 | unchanged |
| Example A6 | P-6 | 1.3 | 1.2 | slightly cracked |
| Example A7 | P-7 | 1.7 | 1.7 | unchanged |
| Example A8 | P-8 | 1.6 | 1.6 | unchanged |
| Example A9 | P-9 | 1.4 | 1.5 | slightly cracked |
| Example A10 | P-10 | 1.5 | 1.5 | unchanged |
| Example A11 | P-11 | 1.3 | 1.3 | unchanged |
| Example A12 | P-12 | 1.5 | 1.5 | unchanged |
| Example A13 | P-13 | 1.6 | 1.6 | unchanged |
| Comp. Ex. A1 | P-14 | 1.0 | 0.5 | dye separated |
| Comp. Ex. A2 | P-15 | 0.8 | 0.4 | dye separated |
| Comp. Ex. A3 | P-16 | 0.5 | 0.3 | dye separated |
| Comp. Ex. A4 | P-17 | 0.5 | 0.3 | dye separated |
| Comp. Ex. A5 | P-18 | 0.6 | 0.3 | dye separated |
| Comp. Ex. A6 | P-19 | 0.7 | 0.4 | dye separated |

[NOTE]
In Table 3,
"A": relative sensitivity immediately after preparation of heat transfer sheet; and
"B": relative sensitivity after preservation at 60° C. for 30 days.

The data shown in Table 3 clearly demonstrate that the heat transfer sheets according to the present invention are superior to the comparative heat transfer sheets. It can be understood that when a dye layer of a heat transfer sheet is prepared by using a sublimable dye, and a binder which comprises organic-solvent-soluble polymers having ester moieties and/or urethane moieties, prepared by modifying water-soluble natural and/or semisynthetic polymers by esterifying inner hydroxyl groups thereof, and when the sublimable dye is homogeneously dissolved in the binder, the dye is not separated from the binder even when the heat transfer sheet is preserved for a prolonged period of time. Moreover, the heat transfer sheet can produce an image with high density even when only a small amount of thermal energy is applied thereto.

The second embodiment of this invention will now be explained more specifically with reference to the following examples, which are given for illustrating of this invention and are not intended to be limiting thereof. Throughout these examples, quantities expressed in "percent (%)" and "parts" are "percent by weight" and "parts by weight", respectively.

EXAMPLE B1

An ink composition for forming a dye layer, having the following formulation was applied by means of gravure printing onto a surface of a substrate film, a polyethyleneterephthalate film having a thickness of 6 μm, backed with a heat resistive smoothing layer, in an amount of 1.0 g/m$^2$ on dry basis, and then dried, thereby obtaining a continuous film of a heat transfer sheet according to the present invention.

| <Formulation of Ink Composition> | |
|---|---|
| Dye having the following formula: | 5.50 parts |

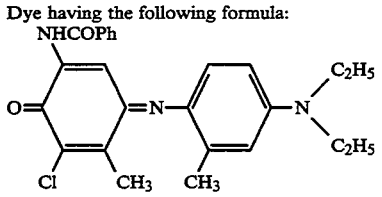

| | |
|---|---|
| Cellulose acetate (binder, acetylation rate: 2.75, total substitution rate: 2.75) | 3.00 parts |
| Methylene chloride | 81.50 parts |
| Ethanol | 9.00 parts |

EXAMPLE B2

The procedure in Example B1 was repeated except that the cellulose acetate used as a binder in the ink composition prepared in Example B1 was replaced by cellulose acetate having an acetylation rate of 2.90, and a total substitution rate of 2.90, thereby obtaining a heat transfer sheet according to the present invention.

EXAMPLE B3

The procedure in Example B1 was repeated except that the cellulose acetate used as a binder in the ink composition prepared in Example B1 was replaced by cellulose acetate having an acetylation rate of 2.40, and a total substitution rate of 2.80 (including a rate of phenylurethane moieties of 0.4), thereby obtaining a heat transfer sheet according to the present invention.

EXAMPLE B4

The procedure in Example B1 was repeated except that the cellulose acetate used as a binder in the ink composition prepared in Example B1 was replaced by cellulose acetate having an acetylation rate of 2.60, and a total substitution rate of 2.90 (including a rate of ethylurethane moieties of 0.3), thereby obtaining a heat transfer sheet according to the present invention. Comparative Example B1

The procedure in Example B1 was repeated except that the cellulose acetate used as a binder in the ink composition prepared in Example B1 was replaced by cellulose acetate having an acetylation rate of 2.40, and a total substitution rate of 2.40, thereby obtaining a comparative heat transfer sheet.

Comparative Example B2

The procedure in Example B1 was repeated except that the cellulose acetate used as a binder in the ink composition prepared in Example B1 was replaced by a polyvinyl butyral resin, Trademark "S-Lec BX-1" manufactured by Sekisui Chemical Co., Ltd., thereby obtaining a comparative heat transfer sheet.

Evaluation B

1. Preparation of Heat Transfer Image-Receiving Sheet

A coating liquid for forming an image-receiving layer, having the following formulation was applied onto a surface of a substrate film, a sheet of synthetic paper, Trademark "Yupo FPG 150" manufactured by Oji-Yuka Synthetic Paper Co., Ltd., in an amount of 4.5 g/m$^2$ on dry basis, and then dried at 80° C. for 10 minutes, thereby obtaining a heat transfer image-receiving sheet.

| Formulation of Coating Liquid for Forming Image-Receiving Layer: | |
|---|---|
| Polyester resin (Trademark "Vylon 600" manufactured by Toyobo Co., Ltd.) | 4.0 parts |
| Vinyl chloride - vinyl acetate copolymer (Trademark "Denka Vinyl #1000A" manufactured by Denki Kagaku Kogyo | 6.0 parts |

-continued

| Formulation of Coating Liquid for Forming Image-Receiving Layer: | |
|---|---|
| K.K.) | |
| Amino-modified silicone oil (Trademark "X-22-3050C" manufactured by Shin-Etsu Chemical Co., Ltd.) | 0.2 parts |
| Epoxy-modified silicone oil (Trademark "X-22-3000E" manufactured by Shin-Etsu Chemical Co., Ltd.) | 0.2 parts |
| Methyl ethyl ketone | 44.8 parts |
| Toluene | 44.8 parts |

2. Relative Sensitivity

The relative sensitivities of the heat transfer sheets according to the present invention prepared in Examples B1 to B4, and those of the comparative heat transfer sheets prepared in Comparative Examples B1 and B2 were determined after the preparation thereof, by subjecting them to heat transfer printing in accordance with the following manner.

Namely, each heat transfer sheet was superposed on the above-obtained heat transfer image-receiving sheet so that the dye layer faced the dye-receiving layer. Thermal energy was then applied to the back surface of the heat transfer sheet by a thermal head (KMT-85-6, MPD 2) to produce an image in the heat transfer image-receiving sheet. The printing conditions were as follows:

Electric voltage applied to thermal head: 12.0 V

Pulse width: applied step pattern method, 16.0 msec/-line at outset, reduced stepwise every 1 msec Dot density in sub-scanning direction: 6 dots/mm (=33.3 msec/line)

The optical density of each image thus obtained was measured. The optical density of the image obtained by using the heat transfer sheet obtained in Comparative Example B1 was indicated by 1.0, and those of images obtained by using the other sheets were indicated by relative values thereto.

The heat transfer printing sheets according to the present invention and the comparative ones were then preserved at 60° C. for 30 days. Thereafter, the same procedure as the above was repeated, and the relative sensitivities were determined.

The results are shown in Table 4.

TABLE 4

| | Relative Sensitivity | |
|---|---|---|
| | A | B |
| Example B1 | 1.5 | 1.5 |
| Example B2 | 1.6 | 1.6 |
| Example B3 | 1.4 | 1.4 |
| Example B4 | 1.5 | 1.5 |
| Comp. Ex. B1 | 1.0 | 0.7 |
| Comp. Ex. B2 | 1.0 | 1.0 |

"A": relative sensitivity after preparation of heat transfer printing sheet; and "B": relative sensitivity after preservation at 60° C. for 30 days.

The data shown in Table 4 clearly demonstrate that when a heat transfer sheet is prepared by forming a dye layer using cellulose acetate having an acetylation rate of 2.4 or more and a total substitution rate of 2.7 or more as a binder, a sublimable dye contained in the dye layer is not separated from the binder even when the heat transfer sheet is preserved for a long period of time. Moreover, the heat transfer sheet can produce a high-density image even when only a small amount of thermal energy is applied thereto.

What is claimed is:

1. A heat transfer sheet comprising a substrate film, and a dye layer formed thereon, said dye layer comprising (i) a binder which is cellulose acetate containing urethane moieties and having an acetylation rate of 2.4 to 2.9 and a total substitution rate of 2.7 or more, and (ii) a sublimable dye dissolved in said binder.

2. A heat transfer sheet comprising a substrate film, and a dye layer formed thereon, said dye layer comprising (i) a binder which is cellulose acetate having an acetylation rate of 2.4 to 2.9 and a total substitution rate of 2.7 or more, and (ii) a sublimable dye dissolved in said binder, the sublimable dye having an indophenol structure.

* * * * *